US005581155A

United States Patent [19]

Morozov et al.

[11] Patent Number: 5,581,155

[45] Date of Patent: *Dec. 3, 1996

[54] PLASMA ACCELERATOR WITH CLOSED ELECTRON DRIFT

[75] Inventors: Alexei I. Morozov; Antonina I. Bougrova; Valentine T. Niskine; Alexei V. Dessijatskov, all of Moscow, Russian Federation; Dominique Valentian, Rosny, France

[73] Assignee: Societe Europeene De Propulsion, Suresnes, France

[ * ] Notice: The term of this patent shall not extend beyond the expiration date of Pat. No. 5,475,254.

[21] Appl. No.: 367,279

[22] PCT Filed: Sep. 1, 1992

[86] PCT No.: PCT/FR92/00836

§ 371 Date: Jan. 12, 1995

§ 102(e) Date: Jan. 12, 1995

[87] PCT Pub. No.: WO94/02738

PCT Pub. Date: Feb. 3, 1994

[30] Foreign Application Priority Data

Jul. 15, 1992 [FR] France ..... 92 08744

[51] Int. Cl.[6] ..... H01J 1/52; H05H 1/00; F03H 1/00

[52] U.S. Cl. ..... 315/111.21; 315/111.41; 315/111.61; 313/231.31; 313/359.1; 313/362.1; 313/361.1; 60/202

[58] Field of Search ..... 313/359.1, 361.1, 313/231.31, 362.1; 315/111.21, 111.41, 111.61; 60/202

[56] References Cited

U.S. PATENT DOCUMENTS 4,841,197 6/1989 Takayama et al. ..... 313/231.31 X
4,862,032 8/1989 Kaufman et al. ..... 313/359.1
5,218,271 6/1993 Egorov et al. ..... 315/111.61
5,475,354 12/1995 Valentian et al. ..... 335/296

FOREIGN PATENT DOCUMENTS 0077764 3/1989 Japan ..... 60/202

OTHER PUBLICATIONS

"Technology of Closed-Drift Thrusters" by H. Kaufman AIAA Journal, vol. 23, No. 1, pp. 78–87.

"Open Single-Lens Hall-Current Accelerator", V. N. Dem'yanenko, et al, vol. 21, No. 8, Aug. 1976, Soviet Physics Technical Physics, New York, pp. 987–988.

*Primary Examiner*—Robert Pascal
*Assistant Examiner*—Arnold Kinkead
*Attorney, Agent, or Firm*—Weingarten, Schurgin, Gagnebin & Hayes LLP

[57] ABSTRACT

The plasma accelerator comprises: a main annular channel (24) for ionization and for acceleration defined by parts (22) made of insulating material and open at its downstream end (225); at least one hollow cathode (40) associated with ionizable gas feed means (41); and an annular anode (25) concentric with the main annular channel (24) and disposed at a distance from the open downstream end (225). An annular buffer chamber (23) having a dimension in the radial direction which is greater than that of the main annular channel (24) extends upstream therefrom beyond the zone in which the annular anode (25) is placed. Ionizable gas feed means (26) open out upstream from the anode (25) via an annular manifold (27) into a zone distinct from the zone carrying the anode (25). Means (31 to 33, 34 to 38) for creating a magnetic field in the main channel (24) are adapted to produce a magnetic field in said main channel (24) that is essentially radial and that has a gradient with maximum induction at the downstream end (225) of the channel (24).

26 Claims, 5 Drawing Sheets

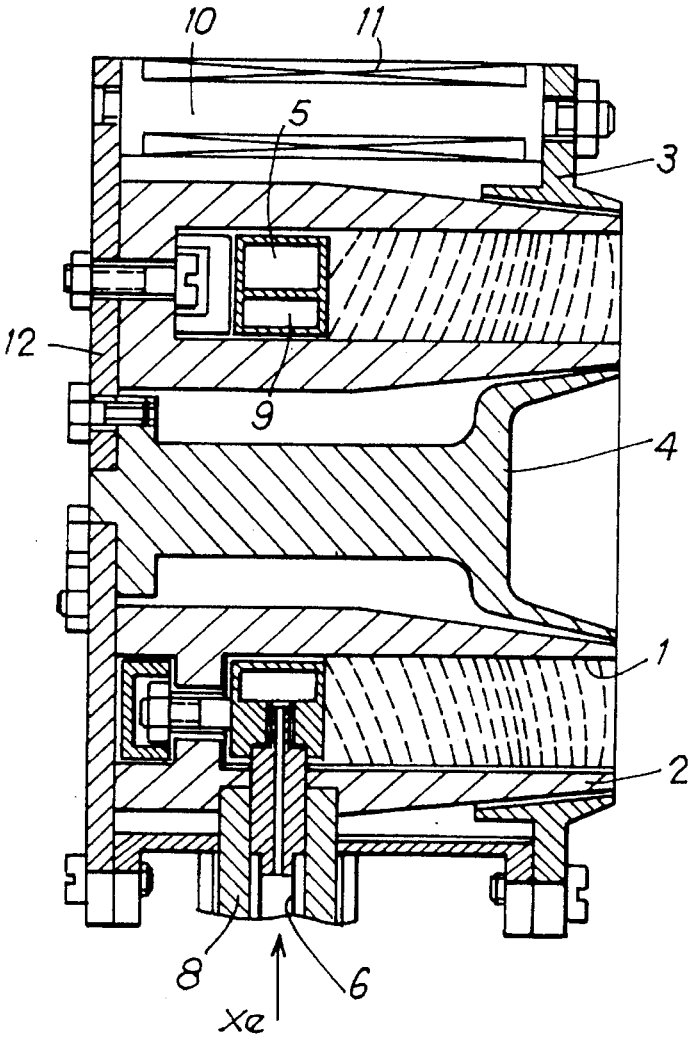
PRIOR ART
FIG. 2
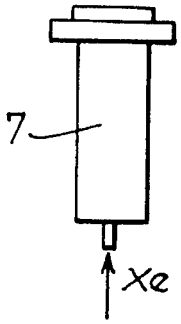
FIG. 3
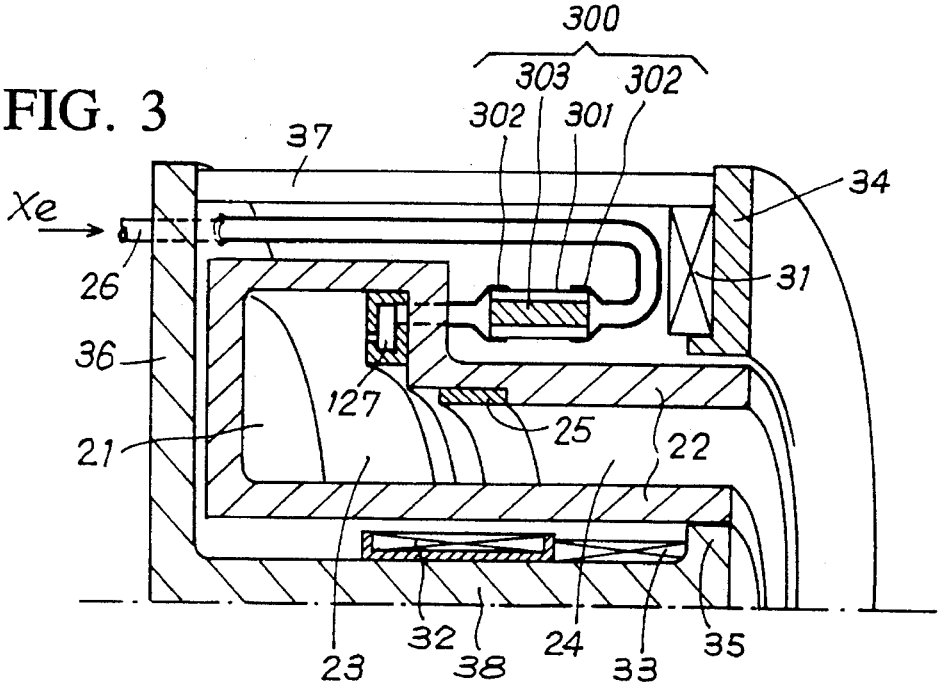

PLASMA ACCELERATOR WITH CLOSED ELECTRON DRIFT

FIELD OF THE INVENTION

The present invention relates to plasma accelerators applied in particular to space propulsion, and more particularly to plasma accelerators of the type having closed electron drift, also known as stationary plasma accelerators, or in the United States of America as "Hall-current accelerators".

PRIOR ART

Electric accelerators are designed essentially for space propulsion applications. As sources of ions or of plasma, they are also used in terrestrial applications, in particular for ion machining. Because of their high specific impulse (1500 s to 6000 s) they make considerable mass savings possible on satellites compared with accelerators that make use of chemical propulsion.

One of the typical applications of accelerators of this type is north-south control of geostationary satellites where they make a mass saving of 10% to 15% possible. They can also be used for compensating drag in low orbit, for maintaining a heliosynchronous orbit, and for primary interplanetary propulsion.

Ion thrusters can be divided into several categories.

A first type of ion thruster is thus constituted by an accelerator in which ionization is performed by bombardment, also known as a Kaufman accelerator. Examples of thrusters of that type are described, in particular, in documents EP-A-0 132 065, WO 89/05404, and EP-A-0 468 706.

In an accelerator making use of ionization by bombardment, atoms of thrust gas are injected at low pressure into a discharge chamber where they are bombarded by electrons emitted by a hollow cathode and collected by an anode. The ionization process is magnified by the presence of a magnetic field. A certain number of the atom-electron collisions cause a plasma to be created in which the ions are attracted by the acceleration electrodes (outlet grids), themselves at a potential that is negative relative to the potential of the plasma. The electrodes concentrate and accelerate the ions which leave the thruster in the form of widely spreading radiation. The ion radiation is then neutralized by a flux of electrons emitted from an external hollow cathode called a "neutralizer".

The specific impulse ($I_{sp}$) obtained from thrusters of that type is of the order of 3000 seconds and above.

The power requirement is about 30 W per mN of thrust.

Other types of ionization accelerator are constituted by accelerators using radiofrequency ionization, accelerators using ionization by contact, or field emission accelerators.

Those various ionization accelerators, including accelerators using ionization by bombardment share the common feature of having their ionization function clearly separated from their ion-acceleration function.

They also share in common the fact of presenting current density in the ion optics that is limited by the space charge phenomenon, which density is limited in practice to 2 mA/cm$^2$ to 3 mA/cm$^2$ in accelerators using ionization by bombardment, and thus of presenting thrust per unit area that is rather low.

In addition, such accelerators and bombardment accelerators in particular require a certain number of electricity feeds (in the range 4 to 10), thereby leading to the implementation of rather complex electronic circuits for conversion and control.

Accelerators are also known, in particular from an article by L. H. ARTSIMOVITCH et al., published in 1974 and concerning the program for developing the stationary plasma accelerator (SPD) and tests on the "METEOR" satellite, which accelerators are of the "closed electron drift" type, also known as "stationary plasma" accelerators, which differ from the other categories by the fact that ionization and acceleration are not distinguished and the acceleration zone includes equal numbers of ions and of electrons, thereby making it possible to eliminate any space charge phenomenon.

A closed electron drift accelerator as proposed in the above-specified article by L. H. ARTSIMOVITCH et al. is described below with reference to FIG. 2.

An annular channel 1 defined by a part 2 made of insulating material is placed in an electromagnet comprising external and internal annular pole pieces 3 and 4 placed respectively outside and inside the part 2 made of insulating material, a magnetic yoke 12 disposed upstream from the accelerator, and electromagnet coils 11 which extend over the entire length of the channel 1 and which are connected in series around magnetic cores 10 connecting the outer pole piece 3 to the yoke 12. A hollow cathode 7 connected to ground is coupled to a xenon feed device for forming a plasma cloud in front of the downstream outlet of the channel 1. An annular anode 5 connected to the positive pole of an electrical power supply source, e.g. at 300 volts, is disposed in the closed upstream portion of the annular channel 1. A xenon injection tube 6 co-operating with a thermal and electrical insulator 8 opens out into an annular distribution channel 9 or "manifold" disposed in the immediate vicinity of the annular anode 5.

Ionization and neutralization electrons come from the hollow cathode 7. The ionization electrons are attracted into the insulating annular channel 1 by the electric field that exists between the anode 5 and the cloud of plasma coming from the cathode 7.

Under the effect of the electric field E and of the magnetic field B created by the coils 11, the ionization electrons follow an azimuth drift trajectory that is necessary for maintaining the electric field in the channel.

The ionization electrons then drift around closed trajectories inside the insulating channel, whence the name of the accelerator.

The drift motion of the electrons considerably increases the probability of collision between the electrons and neutral atoms, where collision is the phenomenon that produces the ions (in this case of xenon).

The specific impulse obtained by conventional closed electron drift ion accelerators operating on xenon is of the order of 1000 seconds to 2500 seconds.

In conventional closed electron drift ion accelerators, the ionization zone is not organized, which has the result that they operate well only with xenon, that the jet is divergent (beam spread over an angle of ±20° ), and efficiency is limited to about 50%.

In addition, the divergence of the jet gives rise to wear of the wall of the insulating channel which is made of a material that is conventionally a mixture of boron nitride and of alumina.

The lifetime of such a motor is about 3000 hours.

OBJECT AND BRIEF SUMMARY OF THE INVENTION

An object of the present invention is to remedy the drawbacks of known plasma accelerators and more particularly to modify closed electron drift plasma accelerators so as to improve their technical characteristics, and in particular so as to enable the ionization zone to be better organized but without thereby creating a space charge as in ion accelerators using bombardment, for example.

The invention also seeks to reduce the divergence of the beam and to increase the density of the ion beam, electrical efficiency, specific impulse, and lifetime.

These objects are achieved by a closed electron drift plasma accelerator comprising a main annular channel for ionization and acceleration that is open at its downstream end and defined by parts made of insulating material, at least one hollow cathode disposed outside the main annular channel adjacent the downstream portion thereof, an annular anode concentric with the main annular channel and disposed at a distance from the open downstream end, first and second ionizable gas feed means associated respectively with the hollow cathode and with the annular anode, and means for creating a magnetic field in the main annular channel, the accelerator being characterized in that it further comprises an annular buffer chamber whose dimension in the radial direction is larger than that of the main annular channel and which extends upstream therefrom beyond the zone in which the annular anode is placed, in that the second ionizable gas feed means open out upstream from the anode via an annular manifold in a zone that is distinct from the zone carrying the anode, and in that the means for creating a magnetic field in the main channel are adapted to produce an essentially radial magnetic field in said main channel, the field having a gradient with maximum induction at the downstream end of the channel, the field lines being essentially parallel to the outlet face perpendicular to the axis of the accelerator at the downstream end of the channel, and minimum induction in the transition zone situated in the vicinity of the anode between the buffer chamber and the main channel so as to enhance ionization of the ionizable gas.

Advantageously, the buffer chamber has a dimension in the radial direction which is about twice the radial dimension of the main channel.

By way of example, the buffer chamber has a dimension in the axial direction which is about 1.5 times the radial dimension of the main channel.

According to an important feature of the invention, the magnetic circuit comprises a plurality of distinct magnetic field creation means together with internal and external plane radial pole pieces that are disposed level with the outlet face on either side of the main channel and that are connected to each other by a central core, a yoke situated upstream from the buffer chamber, and a peripheral magnetic circuit disposed axially outside the main channel and the buffer chamber.

In which case, more particularly, the distinct magnetic field creation means comprise first means disposed around and outside the main channel in the vicinity of the downstream end thereof, second means disposed around the central core in a zone facing the anode and extending partially to face the buffer chamber, and third means disposed around the central core between the second means and the downstream end of the main channel.

Advantageously, the first, second, and third magnetic field creation means are of different sizes.

In one possible embodiment, the first, second, and third magnetic field creation means are constituted by induction coils.

Nevertheless, in certain applications, the first, second, and third magnetic field creation means are formed at least in part by permanent magnets having a Curie point that is higher than the operating temperature of the accelerator.

In particular because of the physical separation of the anode and of the ionizable gas manifold, because of the existence of a buffer chamber, and because a radial magnetic field is implemented having a particular gradient, the plasma accelerator of the invention presents the following set of advantages:

a) more effective ionization, giving rise to higher efficiency;

b) the possibility of easily ionizing various thrust gases such as xenon, argon, etc. . . . because the ionization process is improved; and c) electrostatic equipotentials are obtained that reduce the divergence of the beam, thus:

c1) facilitating integration in a satellite;

c2) reducing wear of the acceleration channel.

BRIEF DESCRIPTION OF THE DRAWINGS

Other characteristics and advantages of the invention appear from the following description of particular embodiments, given as non-limiting examples and made with reference to the accompanying drawings, in which:

FIG. 2 is an axial section view showing an example of a prior art closed electron drift plasma accelerator;

FIG. 3 is an axial half-section view showing a variant embodiment of the invention with a different disposition of the ionizable gas injection means;

DETAILED DESCRIPTION OF PARTICULAR EMBODIMENTS

Figure 1:
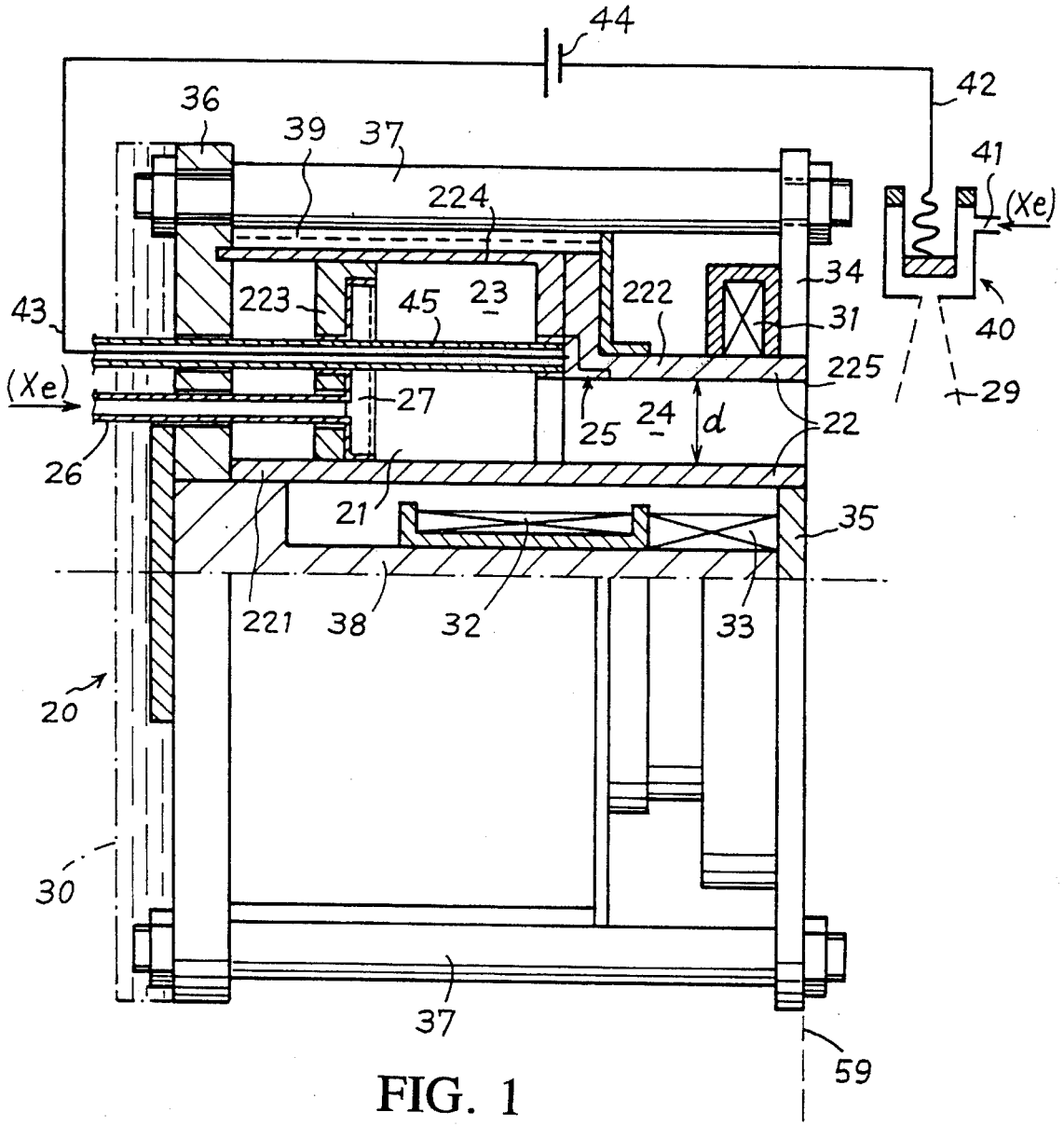
FIG. 1 is a view in elevation and in axial half-section showing an example of a closed electron drift plasma accelerator of the present invention.

FIG. 1 shows an example of a closed electron drift plasma accelerator 20 of the invention which comprises a set of parts 22 made of insulating material defining an annular channel 21 formed upstream from a first portion constituted by a buffer chamber 23 and downstream from a second portion constituted by an acceleration channel 24.

The dimension of the annular chamber 23 in the radial direction is preferably about twice the dimension of the annular acceleration channel 24 in the radial direction. In the axial direction, the buffer chamber 23 may be a little shorter than the acceleration channel 24 and its length is advantageously about one and a half times the dimension d in the radial direction of the acceleration channel 24.

An anode 25 connected by an electricity line 43 to a DC voltage source 44 (e.g. at about 200 V to 300 V) is disposed on the insulating part 22 defining the annular channel 21 in a zone situated immediately downstream from the buffer chamber 23 at the inlet to the acceleration channel 24. The line 43 powering the anode 25 is disposed in an insulating tube 45 which passes through the end of the accelerator constituted by a plate 36 forming a magnetic yoke and parts 223 and 224 made of insulating material defining the buffer chamber 23.

A tube 26 for feeding an ionizable gas such as xenon also passes through the yoke 36 and the end wall 223 of the buffer chamber 23 to open out into an annular gas manifold 27 placed in the end of the buffer chamber 23.

The channel 21 defined by the set of insulating parts 22 is placed in a magnetic circuit essentially made up of three coils 31, 32, and 33 and of pole pieces 34 and 35.

External and internal plane pole pieces 34 and 35 are placed in the outlet plane of the accelerator outside the acceleration channel 24 and define magnetic field lines which, in the open downstream portion of the acceleration channel 24, are substantially parallel to the outlet plane 59 of the accelerator 20.

The magnetic circuit constituted by the pole pieces 34 and 35 is closed by an axial central core 38 and by connection bars 37 disposed around the periphery of the accelerator in an essentially cylindrical configuration, the central core 38 made of ferromagnetic material and the collection bars 37 made of ferromagnetic material being in contact with the rear yoke 36. The yoke 36 which is also made of ferromagnetic material and which constitutes the end wall of the accelerator may be protected by one or more layers 30 of thermal superinsulation material which eliminates the heat flux radiated towards the satellite.

An antipollution screen 39 may also be disposed between the insulating parts 22 and the connection bars 37. In a variant embodiment, the connection bars 37 and the screen 39 are replaced by a cylindrical or cylindro-conical ferrule which acts simultaneously as a screen and to close the magnetic circuit. In all cases, the screen 39 must not hinder cooling of the accelerator. It must therefore either be provided with an internal and external emissive coating, or else it must be applied in such a manner as to permit direct radiation into space.

The electrons necessary for operation of the accelerator are provided by a hollow cathode 40 which may be of conventional design. The cathode 40 which is electrically connected by a line 42 to the negative pole of the voltage source 44 includes a circuit 41 for feeding it with an ionizable gas such as xenon, and it is placed downstream from the outlet zone of the acceleration channel 24.

The hollow cathode 40 provides a plasma 29 which is substantially at the reference potential from which electrons are extracted heading towards the anode 25 under the effect of the electrostatic field E due to the potential difference between the anode 25 and the cathode 40.

These electrons have an azimuth drift trajectory in the acceleration channel 24 under the effect of the electric field E and of the magnetic field B.

Typically, the field at the outlet from the channel 24 is 150 Oe to 200 Oe.

The primary electrons are accelerated by the electrostatic field E, and they strike against the insulating wall 22, thereby supplying secondary electrons at lower energy.

The electrons come into collision with the neutral xenon atoms coming from the buffer chamber 23.

The xenon ions formed in this way are accelerated by the electrostatic field E in the acceleration channel 24.

There is no space charge in the acceleration channel 24 because of the presence of the electrons.

The ion beam is neutralized by a fraction of the electrons coming from the hollow cathode 40.

The gradient of the radial magnetic field is kept under control by the disposition of the coils 31 to 33 and of the pole pieces 34 and 35 which makes it possible to separate the function of accelerating the ions from the ionization function obtained in the zone close to the anode 25. This ionization zone may extend in part into the buffer chamber 23.

An important characteristic of the invention lies in the existence of a buffer chamber 23 which enables the ionization zone to be optimized.

In conventional closed electron drift accelerators, a considerable portion of ionization is located in the middle portion. Some of the ions strike the walls, thereby giving rise to rapid wear of the walls and thus reducing the lifetime of the thruster. The buffer chamber 23 facilitates reducing the plasma concentration gradient in the radial direction and also facilitates cooling of the electrons at the inlet to the acceleration channel 24, thereby reducing the divergence of the ion beam against the walls and thus avoiding loss of ions by collision therewith, which has the effect both of increasing efficiency and of reducing the divergence of the beam at the outlet from the accelerator.

Another important feature of the invention lies in the presence of three coils 31 to 33 which can be of different dimensions, thereby enabling the magnetic field to be optimized because of their specific localization.

Thus, a first coil 31 is disposed around and outside the main channel 24 near the downstream end 225 thereof. A second coil 32 is disposed around the central core 38 in a zone facing the anode 25 and it extends partially to face the buffer chamber 23. A third coil 33 is disposed around the central core 38 between the second coil 32 and the downstream end 225 of the main acceleration channel 24. The coils 31, 32, 33 may be of different sizes, as shown in FIG. 1. The presence of three clearly distinguished coils 31, 32, 33 has the effect of creating field lines that are better directed and that make it possible to obtain a jet that is channeled better and that is more parallel than is the case with conventional accelerators.

In a variant embodiment, the coils 31 to 33 for creating a magnetic field may be replaced, at least in part, by permanent magnets having a Curie point that is higher than the operating temperature of the accelerator.

The annular coil 31 could also be replaced by a set of coils that are individual and disposed around the various connection bars 37 constituting the peripheral magnetic circuit.

The set of induction coils 31, 32, and 33 could also be connected in series with the electrical power supply source 44 and the cathode 40 in such a manner as to provide self-regulation of the discharge current.

The coils 31, 32, and 33 may be made of copper wire covered with high temperature mineral insulation. The coils 31 to 33 may also be made of coaxial type wire having mineral insulation.

The magnetic material of the circuit constituted by the pole pieces 34 and 35, the central core 38, the bars 37, and the yoke 36 may be of soft iron, of ultrapure iron, or of an iron-chromium alloy having high magnetic permeability.

Cooling of the coils 32 and 33 may be improved by a heat pipe placed on the axis of the magnetic core 38 and dumping heat to the yoke 36 and to the internal radial pole piece 35 that radiate into space.

By way of example, the pole pieces 34 and 35 may have a size of about 20 millimeters in the axial direction.

The number of ampere-turns of each coil 31, 32, and 33, and the ratio between the length and the diameter of each of said coils are determined so as to produce an essentially radial magnetic field in the acceleration channel with the maximum of the magnetic field being situated in the outlet plane 59 of the accelerator, its field lines close to the outlet 225 being essentially parallel to the outlet face 59, and its field lines in the vicinity of the anode 25 being disposed essentially in such a manner as to facilitate ionization of the thrust gas in this region.

Examples of ion thrusters of the invention combining the presence of a buffer chamber 23 and a set of different coils 31, 32, 33 have enabled electrical efficiency of the order of 50% to 70% to be obtained, i.e. an improvement on average of about 10% to 25% over previously known systems.

Furthermore, in embodiments of the invention, a jet has been obtained at the outlet from the accelerator that is almost cylindrical, having very small divergence of the ion beam (about ±9° ). Thus, with an acceleration channel having an outside diameter of 80 mm, and at a distance of 80 mm outside the accelerator measured from the outlet plane 59, 90% of the energy remains concentrated within the diameter of the acceleration channel.

In general, the accelerator of the invention makes greater thrust density possible (e.g. of the order of 1 $mN/cm^2$ to 2 $mN/cm^2$ of thrust density per unit area), thus making it possible to have a smaller and lighter accelerator for equal thrust, while also obtaining excellent efficiency.

With respect to lifetime, known accelerators present a lifetime of about 3000 hours.

In contrast, a plasma accelerator of the present invention makes it possible to obtain a lifetime of at least 5000 hours to 6000 hours because of the reduced erosion of the channel 24 associated with the ionized jet being more cylindrical.

Numerous variant embodiments of the plasma accelerator of the invention are possible.

Thus, the insulating material constituting the parts 22 defining the buffer chamber 23 and the acceleration chamber 24 may be made, in particular by any one of the following combinations:

$BN+B_4C+Al_2O_3$ ceramic;

ultrapure alumina;

$Al_2O_3$–$Al_2O_3$ composite; or vitroceramic based on silica that is pure or deposited, e.g. with a rare earth oxide.

Figure 9:
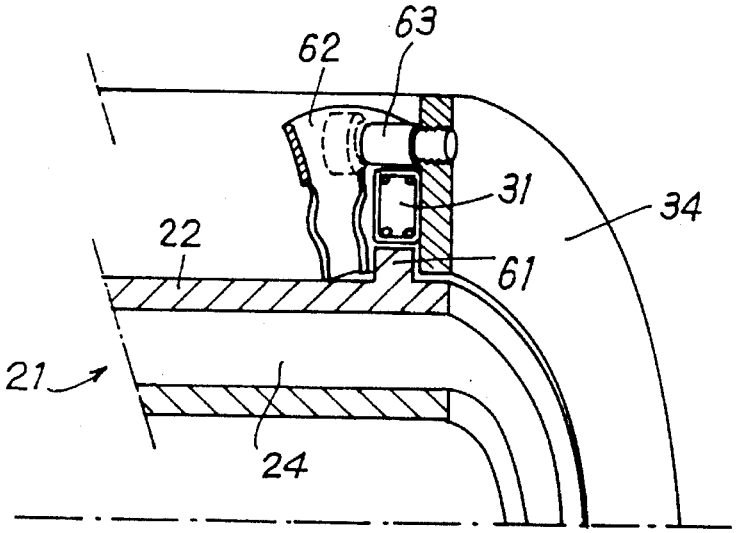
FIG. 9 is a detail view showing an example of how the insulating part defining the main channel of a plasma accelerator of the invention are fixed together.

The insulator 22 may be fixed relative to one of the pole parts, e.g. the part 34, using a resilient intermediate part 62 made of a metal whose coefficient of expansion is close to that of the ceramic (FIG. 9).

This makes it possible to eliminate thermal stresses due to differences in the expansion coefficient of the ceramic or the like and of the magnetic circuit. Under such circumstances, the parts 22 defining the channel 24 may have a flange 61 for retaining the resilient intermediate part 62 and it may be fixed to the pole piece 34 by means of a coupling screw 63.

The coupling between the ceramic material constituting the insulating part 22 and the metal of the pole pieces 34, 35 may also be achieved by brazing, by diffusion welding, by sintering a ceramic-metal composition, or by hot isostatic pressing.

The power dissipated in the form of heat losses in the anode 25 and in the channel 24 may be dumped by radiation from the channel 24 into space downstream, and also by radiation from the magnetic circuit. In order to avoid interactions between the plasma 29 from the cathode 40 and the parts 22 of the insulator, the insulator may be surrounded by a screen 39 situated between the pole piece 34 and the yoke 36, as mentioned above. To enable the screen 39 to be cooled by radiation, it is covered with a high emissivity coating or it is perforated. If it is perforated, the holes must be small enough to prevent plasma penetrating through them.

The xenon manifold 27 may be made of stainless steel or of niobium or out of the same ceramic as the insulating parts 22.

By way of example, the anode 25 may itself be made of stainless steel, of nickel alloy, of niobium, or of graphite.

The electrical power supply to the anode 25 is provided via a hermetically sealed ceramic/metal feedthrough.

The xenon feed to the annular manifold 27 may be provided via an insulating tube if the manifold 27 is itself made of metal, so as to avoid a discharge occurring in the buffer chamber 23 between the anode 25 and the manifold 27 which would be at ground potential in the absence of the insulating tube.

FIG. 3 shows an example of the insulating tube 300 for a metal manifold 127 which, in a variant embodiment, is not located at the end of the buffer chamber 23, but in a downstream portion of said chamber 23 while nevertheless being separated from the anode 25 which is itself placed at the inlet of the acceleration chamber 24. The insulating tube may also be disposed radially at the periphery of the chamber.

By way of example, in FIG. 3, the insulating tube 300 comprises a ceramics tube 301 brazed at both ends to metal endpieces 302 and filled internally with packing 303 which may be a ceramic felt, a bed of insulating granules, or a stack of insulating plates and of metal grids.

In the example shown in FIG. 3, the insulating tube 300 extends along the acceleration channel 24 between the buffer chamber 23 and the coil 31 so as to minimize the total length of the accelerator.

Nevertheless, the insulating tube 300 could also be placed between the yoke 36 and the buffer chamber 23.

Figure 4:
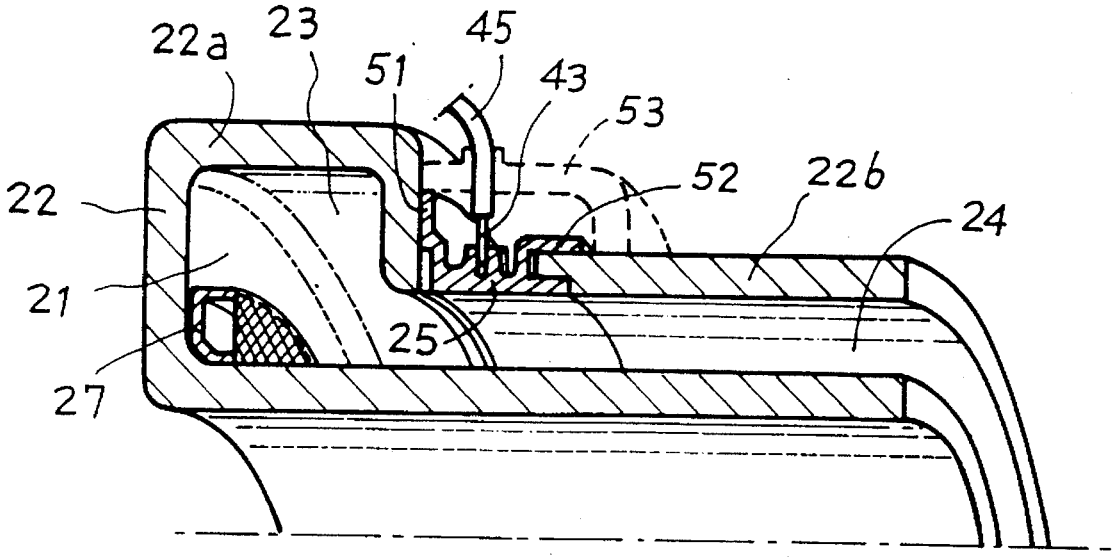
FIG. 4 is a fragmentary axial half-section view of a plasma accelerator of the invention showing an embodiment of the assembly constituted by the buffer chamber, the main channel, the anode, and the ionized gas manifold.
Figure 5:
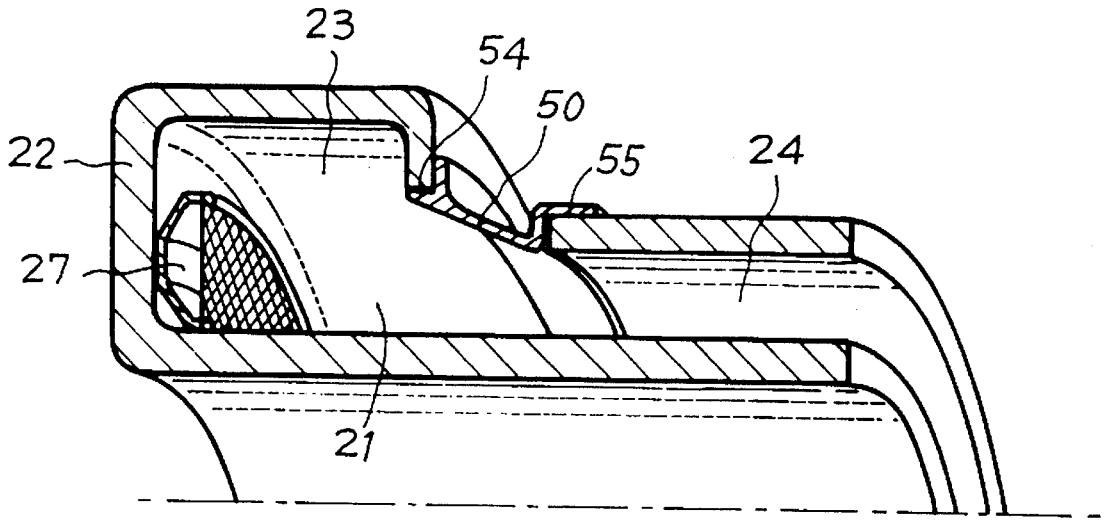
FIG. 5 is a fragmentary axial half-section view of a plasma accelerator of the invention showing an alternate embodiment of the assembly constituted by the buffer chamber, the main channel, the anode, and the ionizable gas manifold.
Figure 6:
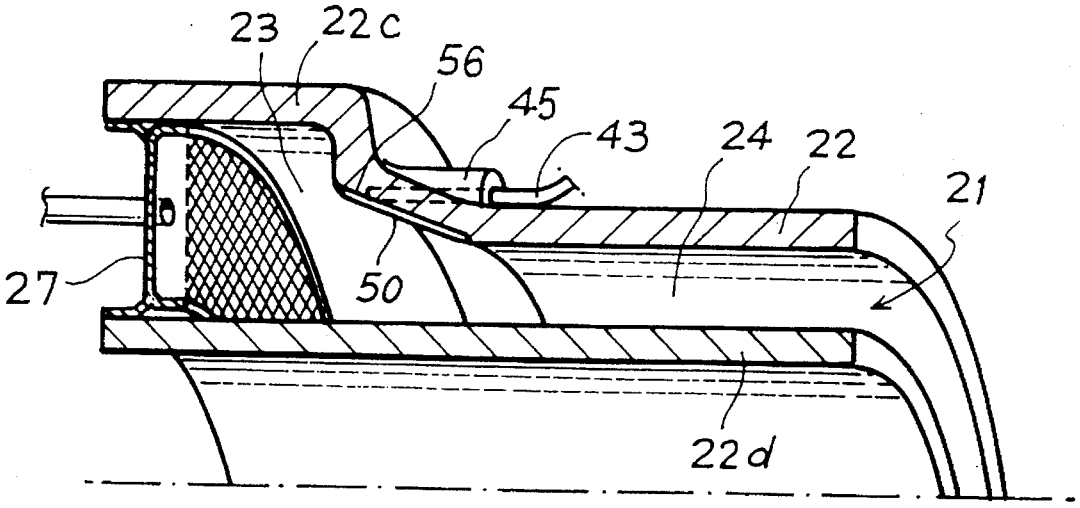
FIG. 6 is a fragmentary axial half-section view of a plasma accelerator of the invention showing another alternate embodiment of the assembly constituted by the buffer chamber, the main channel, the anode, and the ionizable gas manifold.

The insulating parts 22 defining the buffer chamber 23 and the acceleration channel 24 may have various configurations, as can the anode 25 which may be cylindrical (FIGS. 1, 4, 7) or conical (FIGS. 5 and 6).

In FIG. 1, an internal annular part 221 and complementary parts 222, 223, and 224 fitted on the internal part 221 define the buffer chamber 23 and the annular channel 24 while still allowing the manifold 27 and the anode 25 to be mounted.

In the example of FIG. 6, the parts made of insulating material and defining the main channel 24 and the buffer chamber 23, comprise both a first part **22*c* forming an outside wall of the buffer chamber 23 and of the main channel 24, and a second part 22*d* forming an inside wall of the buffer chamber 23 and of the main channel 24, and the ionizable gas manifold 27 placed in the buffer chamber 23** itself constitute a link element between said first and second parts 22*c* and 22*d*. The conical anode 50 may be mounted from the upstream end on a conical transition portion 56 between the buffer chamber 23 and the acceleration chamber 24.

In the example of FIG. 4, the parts made of insulating material and defining the main channel 24 and the buffer channel 23, comprise both a first part 22*a* forming the wall of the buffer chamber 23 and the inside wall of the main channel 24, and a second part 22*b* forming the outside wall of the main channel 24, and the anode is fastened by portions 51 and 52 between the first and second parts 22*a* and 22*b*. Reference 53 designates an optional cover. The manifold 27 may be inserted form the downstream end. The embodiment of FIG. 5 is similar to that of FIG. 4 but shows a conical anode 50 bonded by portions 54 and 55 between the first and second parts 22*a* and 22*b*.

In the examples of FIGS. 1 and 6, the anode is applied against one of the faces of the parts 22 made of insulating material at the junction between the buffer chamber 23 and the main channel 24.

Figure 7:
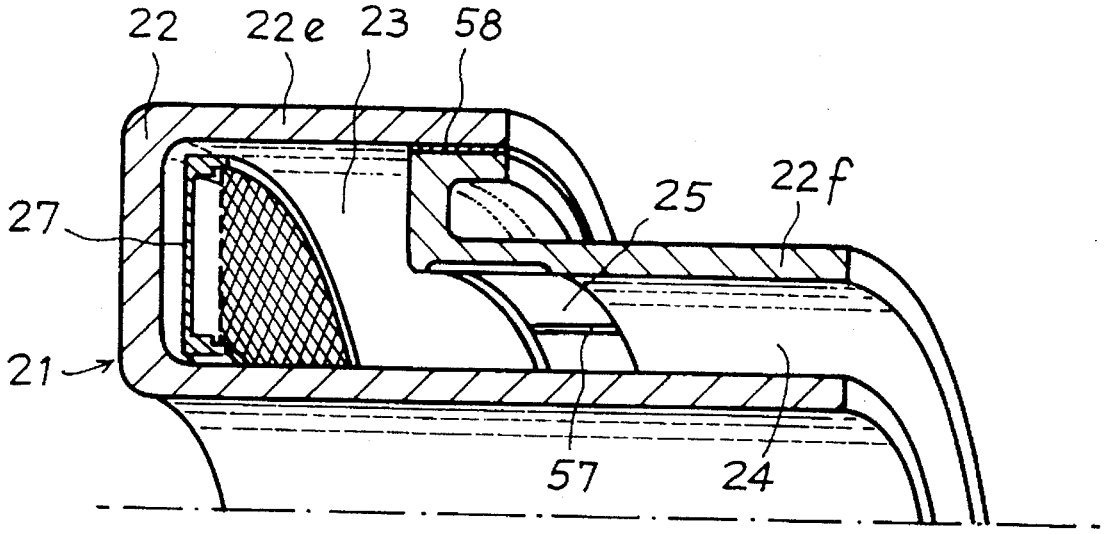
FIG. 7 is a fragmentary axial half-section view of a plasma accelerator of the invention showing another alternate embodiment of the assembly constituted by the buffer chamber, the main channel, the anode, and the ionizable gas manifold.

In the example of FIG. 7, the anode 25 is made up of a plurality of lengths which are electrically interconnected (connection 57). The manifold 27 may be inserted from the downstream end. At the junction 58 between the parts 22*e* and 22*f* made of insulating material there is a ceramic to ceramic seal enabling the channel to be built up from two separate elements.

Figure 8:
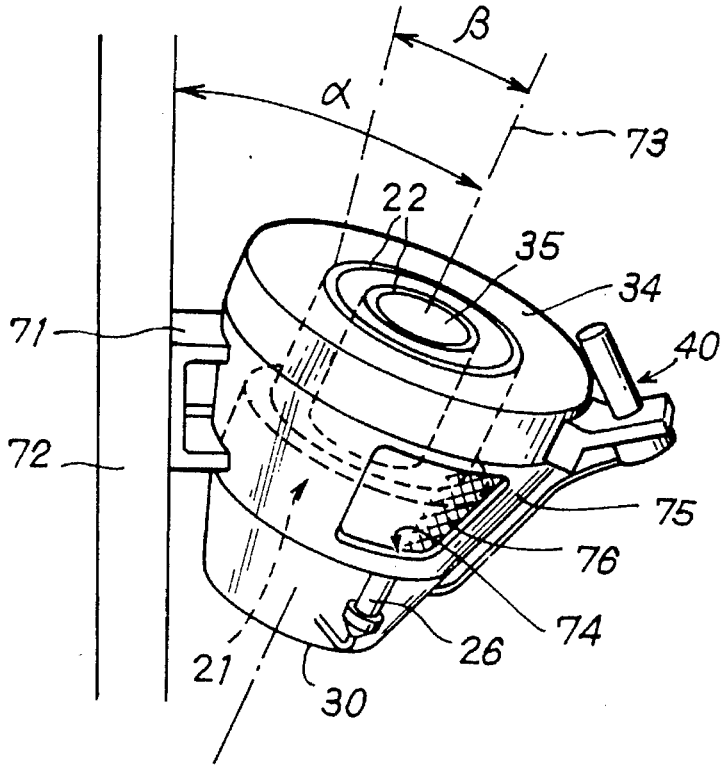
FIG. 8 is a perspective view of an example of a plasma accelerator of the invention mounted on the structure of a satellite.

FIG. 8 shows an embodiment in which an external ferrule 75 of magnetic material also constitutes an interface for fixing the accelerator to the structure 72 of a satellite. Reference 71 designates the mechanical interface of the accelerator and reference 72 designates the wall of the satellite parallel to the north-south axis of the geostationary satellite.

Angle $\alpha$ represents the angle of inclination of the accelerator relative to the north-south axis 73 of the satellite.

$\beta$ in this case is always smaller than $\alpha$ and represents the divergence half-angle of the ion beam.

Radiation windows 74 are made through the ferrule 75 and are covered by a perforated screen 76 that may be a metal sieve.

Other embodiments of the plasma accelerator of the invention are naturally possible.

We claim:

1. A closed electron drift plasma accelerator comprising:

a main annular channel having an axis for ionization and acceleration that is open at its downstream end and defined by parts made of insulting material;

a hollow cathode disposed outside the main annular channel adjacent to the downstream end thereof; an annular anode concentric with the main annular channel and disposed at a distance from the open downstream end;

first and second ionizable gas feed means associated respectively with the hollow cathode and with the annular anode;

a magnetic circuit for creating a magnetic field in the main annular channel;

an annular buffer chamber whose dimension in the radial direction is larger than that of the main annular channel and which extends upstream therefrom beyond a zone in which the annular anode is placed, the second ionizable gas feed means opens out into the annular buffer chamber upstream from the annular anode via an annular ionizable gas manifold in a zone that is distinct from the zone carrying the annular anode, and further comprising a first, second and third magnetic field creation means together with internal and external plane radial pole pieces that are disposed level with the downstream end on either side of the main annular channel and that are connected to each other by a central core, a yoke, and a peripheral magnetic circuit disposed axially outside the main annular channel and the annular buffer chamber; and the accelerator being characterized in that the means for creating a magnetic field in the main annular channel are adapted to produce an essentially radial magnetic field in said main annular channel, the field having a gradient with maximum induction at the downstream end of said main annular channel, the field lines being essentially parallel to the plane radial pole pieces perpendicular to the axis of the accelerator at the downstream end of the main annular channel, and minimum induction in a transition zone situated in the vicinity of the annular anode between the buffer chamber and the main annular channel so as to enhance ionization of the ionizable gas, and in that the distinct magnetic field creation means comprise first magnetic field creation means disposed around and outside the main annular channel in the vicinity of the downstream end thereof, second magnetic field creation means disposed around the central core in a zone facing the annular anode and extending partially to face the buffer chamber, and third magnetic field creation means disposed around the central core between the second magnetic field creation means and the downstream end of the main annular channel.

2. A plasma accelerator according to claim 1, characterized in that the buffer chamber has a dimension in the radial direction which is about twice the radial dimension of the main annular channel.

3. A plasma accelerator according to claim 1, characterized in that the buffer chamber has a dimension in the axial direction which is about 1.5 times the radial dimension of the main annular channel.

4. A plasma accelerator according to claim 1, characterized in that the first, second and third magnetic field creation means are of different sizes.

5. A plasma accelerator according to claim 1, characterized in that the first, second and third magnetic field creation means are constituted by induction coils.

6. A plasma accelerator according to claim 1, characterized in that the first, second and third magnetic field creation means are formed at least in part by permanent magnets having a Curie point that is higher than the operating temperature of the accelerator.

7. A plasma accelerator according to claim 1, characterized in that the peripheral magnetic circuit comprises a set of connection rods between the external plane radial pole piece and the yoke.

8. A plasma accelerator according to claim 7, characterized in that the first magnetic field creation means comprises a set of individual induction coils, disposed around the set of connection rods constituting the peripheral magnetic circuit.

9. A plasma accelerator according to claim 1, characterized in that the peripheral magnetic circuit is constituted by an external ferrule.

10. A plasma accelerator according to claim 5, characterized in that the induction coils constituting the first, second, and third magnetic field creation means (31, 32, 33) are connected in series between an electrical power supply source (44) and the hollow cathode (40).

11. A plasma accelerator according to claim 1, characterized in that the annular ionizable gas manifold disposed in the buffer chamber is made of an electrical insulating material.

12. A plasma accelerator according to claim 1, characterized in that the annular ionizable gas manifold disposed in the buffer chamber is made of metal and in that an ionizable gas feed tube opening out into the annular ionizable gas manifold includes electrical insulation means.

13. A plasma accelerator according to claim 12, characterized in that the electrical insulation means (300) of the ionizable gas feed tube (26) are disposed between the yoke (36) and the buffer chamber (23).

14. A plasma accelerator according to claim 12, characterized in that the ionizable gas feed tube and its electrical insulation means are disposed along the main annular channel between the buffer chamber and the first magnetic field creation means.

15. A plasma accelerator according to claim 5, characterized in that it includes a heat pipe placed on the axis of the central core (38) carrying the coils constituting the second and third magnetic field creation means (32, 33) and dumping heat towards the internal radial pole piece (35) and the yoke (36).

16. A plasma accelerator according to claim 1, characterized in that the insulating material parts defining the main annular channel and the buffer chamber comprise:

a first part forming an outside wall of the buffer chamber and of the main annular channel;

a second part forming an inside wall of the buffer chamber and of the main annular channel; and the annular ionizable gas manifold placed in the buffer chamber itself constitutes a link element between said first and second parts.

17. A plasma accelerator according to claim 1, characterized in that the insulating material parts defining the main annular channel and the buffer chamber comprise:

a first part forming the wall of the buffer chamber and the inside wall of the main annular channel;

a second part forming the outside wall of the main annular channel; and the annular anode is fastened between the first and second parts.

18. A plasma accelerator according to claim 1, characterized in that the annular anode is applied to one of the faces of the insulating material parts at the junction between the buffer chamber and the main annular channel.

19. A plasma accelerator according to claim 1, characterized in that the annular anode is cylindrical in shape.

20. A plasma accelerator according to claim 1, characterized in that the annular anode is frustoconical in shape.

21. A plasma accelerator according to claim 1, characterized in that the annular anode is constituted by a plurality of electrically interconnected lengths disposed at a junction between the buffer chamber and the main annular channel.

22. A plasma accelerator according to claim 1, characterized in that the insulating parts defining the main annular channel are fixed on the external plane radial pole piece by means of an assembly comprising a flange and a resilient washer.

23. A plasma accelerator according to claim 9, characterized in that the plasma accelerator is fixed to a satellite having a structure and the external ferrule made of magnetic material also constitutes an interface for fixing the accelerator to the structure of the satellite.

24. A plasma accelerator according to claim 8, characterized in that the peripheral magnetic circuit comprises a set of connection rods between the external plane radial pole piece and the yoke.

25. A plasma accelerator according to claim 2, which is adapted to be fixed to a satellite having a structure, characterized in that:

the buffer chamber has a dimension in the axial direction which is about 1.5 times the radial dimension of the main channel;

the first, second, and third magnetic field creation means are of different sizes;

the first, second, and third magnetic field creation means include induction coils connected in series between an electrical power supply source and the hollow cathode, and permanent magnets having a Curie point that is higher than the operating temperature of the accelerator;

the peripheral magnetic circuit comprises a set of connection rods between the external plane radial pole piece and the yoke;

the first magnetic field creation means comprises a set of individual coils disposed around the rods constituting the peripheral magnetic circuit;

the annular ionizable gas manifold disposed in the buffer chamber is made of a material selected from the group consisting of: 1) an electrical insulating material and 2) a metal in combination with the ionizable gas feed tube opening out into the annular ionizable gas manifold, said gas feed tube including electrical insulation means disposed between the yoke and the buffer chamber;

the ionizable gas feed tube and its electrical insulation means are disposed along the main annular channel between the buffer chamber and the first magnetic field creation means;

a heat pipe is placed on the axis of the central core carrying the coils constituting the second and third magnetic field creation means said heat pipe dumping heat towards the internal plane radial pole piece and the yoke;

the insulating material parts defining the main annular channel and the buffer chamber selected from the group consisting of: 1) a first part forming an outside wall of the buffer chamber and the main annular channel; and a second part forming an inside wall of the buffer chamber and the main annular channel; and further characterized in that the annular ionizable gas manifold placed in the buffer chamber itself constitutes a ink element between said first and second parts and wherein the annular anode is applied to one of the faces of the insulating material parts and at a junction between the buffer chamber and the main annular channel said insulating material parts having a shape chosen within the group comprising a frustoconical shape and a cylindrical shape; and 2) a first part forming the wall of the buffer chamber and the inside wall of the main channel; forming the outside wall of the main channel and further characterized in that the annular anode is fastened between the first and second parts;

the annular anode is constituted by a plurality of electrically interconnected lengths disposed at a junction between the buffer chamber and the inlet of the main channel;

the insulating parts defining the main channel are fixed on the external plane radial pole piece by means of an assembly comprising a flange and a resilient washer; and an external ferrule made of magnetic material also constitutes an interface for fixing the accelerator to the structure of a satellite.

26. A plasma accelerator according to claim 25, characterized in that the peripheral magnetic circuit (37) is constituted by a ferrule.

* * * * *

UNITED STATES PATENT AND TRADEMARK OFFICE

CERTIFICATE OF CORRECTION

PATENT NO. : 5,581,155

DATED : December 3, 1996

INVENTOR(S) : Alexei I. Morozov, Antonina I. Bougrova, Valentine T. Niskine, Alexei V. Dessijatskov and Dominique Valentian It is certified that error appears in the above-identified patent and that said Letters Patent is hereby corrected as shown below:

On the title page

Item [*] Notice:

"5,475,254" should read --5,475,354--.

Signed and Sealed this

Second Day of January, 2001

*Attest:*

*Attesting Officer*

Q. TODD DICKINSON

*Commissioner of Patents and Trademarks*